US008516650B2

(12) United States Patent
Beers

(10) Patent No.: US 8,516,650 B2
(45) Date of Patent: Aug. 27, 2013

(54) VACUUM ELECTRONIC WATER SENSE CIRCUIT

(75) Inventor: David R. Beers, Dallastown, PA (US)

(73) Assignee: Black & Decker Inc., Newark, DE (US)

( * ) Notice: Subject to any disclaimer, the term of this patent is extended or adjusted under 35 U.S.C. 154(b) by 878 days.

(21) Appl. No.: 11/870,950

(22) Filed: Oct. 11, 2007

(65) Prior Publication Data

US 2009/0094778 A1 Apr. 16, 2009

(51) Int. Cl.
*A47L 9/28* (2006.01)

(52) U.S. Cl.
USPC ..... 15/319; 15/339

(58) Field of Classification Search
USPC ..... 15/319, 339, 300.1
See application file for complete search history.

(56) References Cited

U.S. PATENT DOCUMENTS

| | | | | |
|---|---|---|---|---|
| 1,864,622 | A | 6/1932 | Sutherland | |
| 2,522,882 | A | 9/1950 | Lofgren | |
| 2,570,307 | A | 10/1951 | Bell et al. | |
| 3,009,188 | A | 11/1961 | Martin | |
| 3,236,032 | A | 2/1966 | Yasukawa et al. | |
| 3,320,726 | A | 5/1967 | Black, Jr. | |
| 3,591,888 | A | 7/1971 | Takeda et al. | |
| 3,656,083 | A | 4/1972 | Brook | |
| 3,695,006 | A | 10/1972 | Valbona et al. | |
| 3,708,962 | A | 1/1973 | Deguchi et al. | |
| 3,800,205 | A | 3/1974 | Zalar | |
| 3,936,904 | A | 2/1976 | Bashark | |
| 4,021,879 | A | 5/1977 | Brigham | |
| 4,070,078 | A | 1/1978 | Chrones | |
| 4,179,768 | A | 12/1979 | Sawyer | |
| 4,266,257 | A | 5/1981 | Rudich, Jr. | |
| 4,302,624 | A | 11/1981 | Newman | |
| 4,321,826 | A | 3/1982 | Bibbee et al. | |
| 4,357,729 | A | 11/1982 | Vander Molen et al. | |
| 4,398,316 | A | 8/1983 | Scott et al. | |
| 4,465,485 | A | 8/1984 | Kashmer et al. | |
| 4,611,365 | A | 9/1986 | Komatsu et al. | |
| 4,628,440 | A | 12/1986 | Thompson et al. | |
| 4,654,924 | A | 4/1987 | Getz et al. | |
| 4,723,337 | A | 2/1988 | Ellison et al. | |
| 4,825,140 | A | 4/1989 | St. Louis | |
| 4,841,595 | A | 6/1989 | Wiese | |
| 4,864,680 | A | 9/1989 | Blase et al. | |
| 5,072,484 | A | 12/1991 | Edlund et al. | |
| 5,099,157 | A | 3/1992 | Meyer | |
| 5,111,188 | A | 5/1992 | Turloff et al. | |
| 5,120,983 | A | 6/1992 | Samann et al. | |
| 5,205,014 | A | 4/1993 | Yoo et al. | |
| 5,256,906 | A | 10/1993 | Tsuge et al. | |
| 5,265,305 | A | 11/1993 | Kraft et al. | |
| 5,267,370 | A * | 12/1993 | Worwag | 15/319 |
| 5,276,939 | A | 1/1994 | Uenishi et al. | |
| 5,404,612 | A | 4/1995 | Ishikawa et al. | |
| 5,449,988 | A | 9/1995 | Gurstein et al. | |
| 5,465,455 | A * | 11/1995 | Allen | 15/319 |

(Continued)

FOREIGN PATENT DOCUMENTS

| | | |
|---|---|---|
| DE | 8801599 | 4/1988 |
| EP | 0155502 | 9/1985 |

*Primary Examiner* — Dung Van Nguyen
(74) *Attorney, Agent, or Firm* — Harness, Dickey & Pierce, P.L.C.

(57) ABSTRACT

A vacuum electronics system is provided including an electronic water sense circuit for sensing the water level and preventing the vacuum source from operating when the water level approaches the vacuum filter.

11 Claims, 7 Drawing Sheets

(56) References Cited

U.S. PATENT DOCUMENTS

| | | | | |
|---|---|---|---|---|
| 5,541,457 | A | 7/1996 | Morrow | |
| 5,553,494 | A | 9/1996 | Richards et al. | |
| 5,554,917 | A | 9/1996 | Kurz et al. | |
| 5,596,181 | A | 1/1997 | Bach et al. | |
| 5,608,945 | A | 3/1997 | Crouser et al. | |
| 5,621,393 | A | 4/1997 | Urich et al. | |
| 5,715,568 | A | 2/1998 | Berfield et al. | |
| 5,747,973 | A | 5/1998 | Robitaille et al. | |
| 5,784,753 | A | 7/1998 | Kaczmarz et al. | |
| 5,850,668 | A | 12/1998 | Berfield et al. | |
| 5,920,955 | A | 7/1999 | Berfield | |
| 5,954,863 | A | 9/1999 | Loveless et al. | |
| 5,955,791 | A | 9/1999 | Irlander | |
| 6,008,608 | A | 12/1999 | Holsten et al. | |
| 6,009,596 | A | 1/2000 | Buss et al. | |
| 6,026,539 | A | 2/2000 | Mouw et al. | |
| 6,029,309 | A | 2/2000 | Imamura et al. | |
| 6,044,519 | A | 4/2000 | Hendrix | |
| 6,049,940 | A * | 4/2000 | Robitaille | 15/319 |
| 6,112,366 | A | 9/2000 | Berfield | |
| 6,119,304 | A | 9/2000 | Berfield et al. | |
| 6,131,236 | A | 10/2000 | Roth et al. | |
| 6,222,285 | B1 * | 4/2001 | Haley et al. | 307/129 |
| 6,226,831 | B1 | 5/2001 | Berfield | |
| 6,249,933 | B1 | 6/2001 | Berfield | |
| 6,347,430 | B1 | 2/2002 | Buss et al. | |
| 6,378,164 | B1 | 4/2002 | Berfield | |
| 6,453,507 | B1 | 9/2002 | Gilbert | |
| 6,481,049 | B1 | 11/2002 | Berfield | |
| 6,508,618 | B2 | 1/2003 | Berfield | |
| 6,526,622 | B2 | 3/2003 | Conrad et al. | |
| 6,569,218 | B2 | 5/2003 | Dudley | |
| 6,610,952 | B2 | 8/2003 | Crevling | |
| 6,625,845 | B2 | 9/2003 | Hayashi et al. | |
| 6,758,874 | B1 | 7/2004 | Hunter, Jr. | |
| 6,812,847 | B1 | 11/2004 | Salem et al. | |
| 6,832,407 | B2 | 12/2004 | Salem et al. | |
| 6,946,967 | B2 | 9/2005 | Klaus et al. | |
| 2004/0177471 | A1 | 9/2004 | Jung et al. | |
| 2004/0187253 | A1 | 9/2004 | Jin et al. | |
| 2005/0091784 | A1 | 5/2005 | Bone | |
| 2005/0120510 | A1 | 6/2005 | Weber | |
| 2005/0132528 | A1 | 6/2005 | Yau | |
| 2005/0198766 | A1 | 9/2005 | Nam et al. | |
| 2005/0217067 | A1 | 10/2005 | Rew et al. | |

* cited by examiner

VACUUM ELECTRONIC WATER SENSE CIRCUIT

FIELD

The present disclosure relates to vacuum electronics, and more particularly to an electronic water sense circuit for a wet/dry industrial vacuum.

BACKGROUND

The statements in this section merely provide background information related to the present disclosure and may not constitute prior art.

Conventional industrial shop vacuums are employed for both wet and dry usage. However, the electronics for conventional industrial shop vacuums can be primitive in design.

Conventional wet/dry vacuums may include a container and a cover that closes the container. The cover may support a vacuum motor that drives a fan to create a vacuum. A flexible hose may be mounted on an inlet to the vacuum for drawing debris (including solids, liquids, and gases) into the container.

SUMMARY

The present disclosure provides electronics for an industrial shop vacuum that includes an electronic water sense circuit for sensing the water level and preventing the vacuum source from operating when the water level approaches the vacuum filter.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
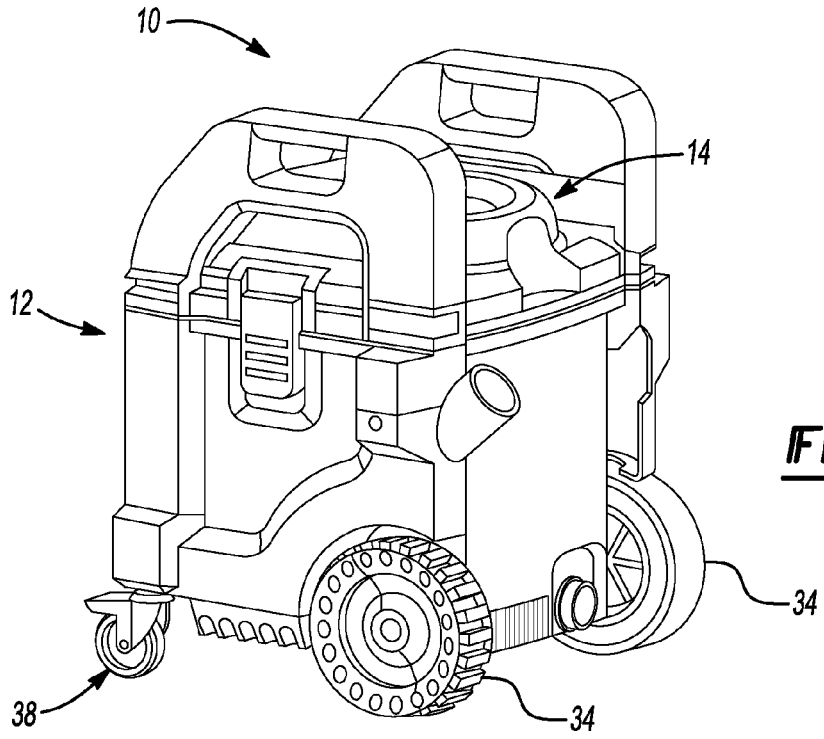
FIG. 1 is a perspective view of an example industrial shop vacuum according to the principles of the present disclosure.

The following description is merely exemplary in nature and is not intended to limit the present disclosure, application, or uses. It should be understood that throughout the drawings, corresponding reference numerals indicate like or corresponding parts and features.

Figure 2:
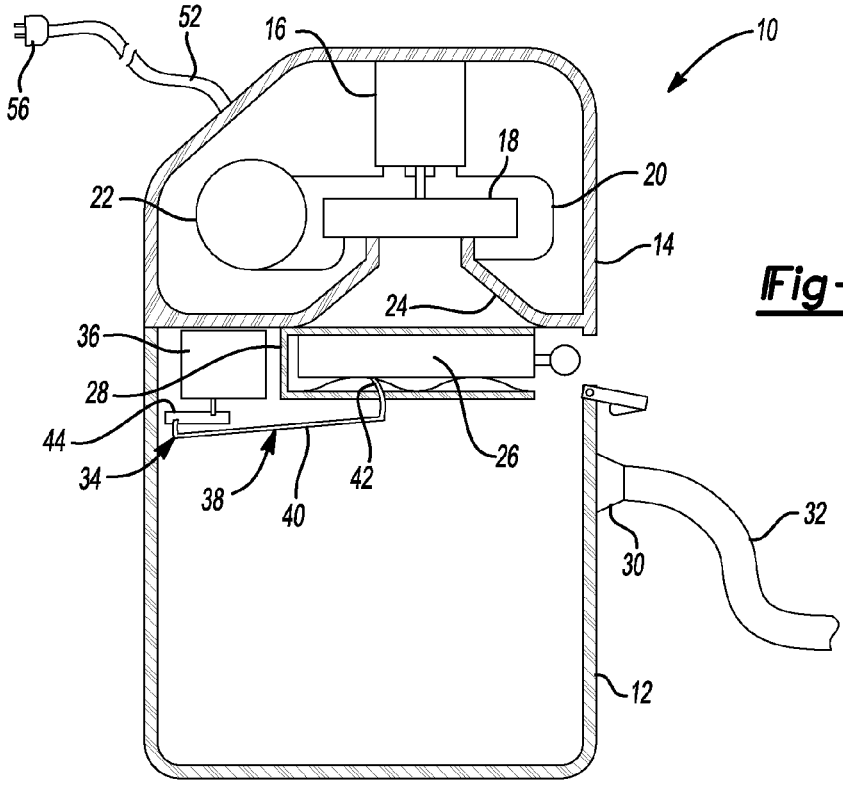
FIG. 2 is a schematic diagram of an example industrial shop vacuum according to the principles of the present disclosure.

With reference to FIGS. 1 and 2, an example vacuum 10, according to the principles of the present disclosure, will now be described. The vacuum 10 may include a canister 12 and a vacuum head 14 that closes the canister 12. The vacuum head may support a drive motor 16. The drive motor 16 may support a suction fan 18, which may be provided in a fan chamber 20 of the vacuum head 14. The fan chamber 20 may be in fluid communication with an exhaust port 22 and an intake port 24. The intake port 24 may be covered by a filter assembly 26 situated in a filter housing 28 of a vacuum head 14.

A motor 16, when powered up, may rotate the suction fan 18 to draw air into the suction inlet opening 30 and through the canister 12, through the filter assembly 26, through the intake port 24 and into the fan chamber 20. The suction fan 18 may push the air in the fan chamber 20 through the exhaust port 22 and out of the vacuum 10. A hose 32 can be attached to the inlet opening 30.

The canister 12 can be supported by wheels 34. The wheels 34 can include caster wheels, or the wheels can alternatively be supported by an axle.

A filter cleaning device 34 is provided including a filter cleaning motor 36 drivingly connected to a filter cleaning mechanism 38. The filter cleaning mechanism 38 can take many forms, and can include an eccentrically driven arm 40 having fingers 42 engaging the filter 26. The filter cleaning device 34 can be driven to traverse across the filter 26 to cause debris that is stuck to the filter to be loosened up and fall into the canister 12. The arm 40 is connected to an eccentric drive member 44 which is connected to motor 36 and, when rotated, causes the arm 40 and fingers 42 to traverse across the surface of the filter 26.

Figure 3:
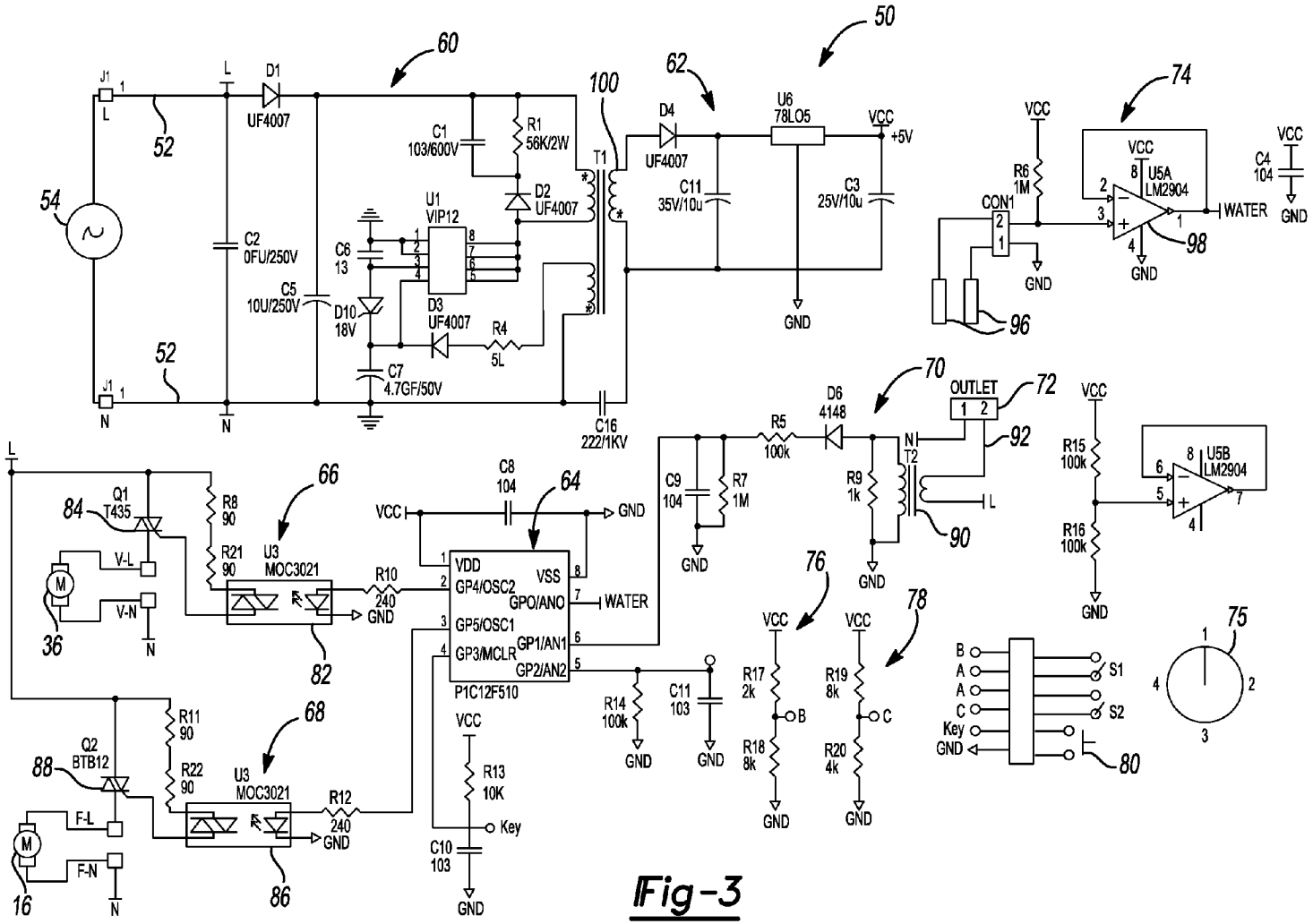
FIG. 3 is a schematic circuit diagram for the electronic controls according to the principles of the present disclosure.

With reference to FIG. 3, a schematic diagram of the electronics 50 utilized to operate the vacuum 10 will now be described. The electronics 50 generally include a power cord 52 extending from the vacuum and adapted for connection with an AC power source 54. In particular, the power cord 52 can include a plug 56 having a two-prong or three-prong connection as is known in the art, as is shown in FIG. 2. The power cord 52 is connected to a power source circuit 60. An electrical isolation circuit 62 is provided in communication with the power source circuit 60 for providing a low voltage output VCC, as will be described in greater detail herein. A microcontroller 64 is provided in communication with the electrical isolation circuit 62 for receiving a low voltage supply VCC therefrom. The microcontroller 64 provides control signals to a filter cleaning circuit 66 and a vacuum circuit 68.

A power tool sense circuit 70 is provided in communication with the microcontroller 64 for providing a signal to the microcontroller 64 regarding operation of a power tool that is plugged into an outlet 72 that can be disposed on the power tool 10. The outlet 72 can be connected to the power cord 52 as indicated by nodes L, N. A water sense circuit 74 is provided in communication with the microcontroller 64 for providing a signal ("WATER") to the microcontroller 64 that the water level in the canister 12 has reached a predetermined level for deactivating the vacuum source in order to prevent water from being drawn into the vacuum filter 26.

A first switch S1 and a second switch S2 are provided for controlling operation of the vacuum motor 16. The switches S1 and S2 are connected to connectors A, B and A, C, respectively, wherein connectors B and C are connected to ratio circuits 76, 78, respectively. Connector A provides an input signal to the microcontroller 64 indicative of the activation state of switch S1 and switch S2 in order to provide four modes of operation utilizing the two switches S1 and S2 while providing just a single input into the microcontroller 64. Table 1 provides a list of the mode selection possibilities with switches S1 and S2 in the different activation states.

TABLE 1

| User Switch Position | S1 | S2 | Microcontroller Input VCC Ratio |
|---|---|---|---|
| 1 | 0 | 0 | 0 * VCC |
| 2 | 0 | 1 | (1/3) * VCC |
| 3 | 1 | 0 | (4/5) * VCC |
| 4 | 1 | 1 | (5/8) * VCC |

With each of the four possible activation states of switches S1 and S2, the ratio circuit 76, 78 provide different ratio input signals as a function of the low voltage supply VCC. In particular, by way of example, as shown in Table 1, when both switch S1 and switch S2 are open, a zero ratio VCC signal is received. When switch S1 is open and switch S2 is closed, a 1/3 ratio VCC signal is provided. When the switch S1 is closed and switch S2 is open, a 4/5 VCC ratio signal is provided, and when both switches S1 and S2 are closed, a 5/8 VCC ratio signal is provided to the microcontroller 64. The ratios are determined by the resistance levels of the resistors R17-R20 provided in the ratio circuits 76, 78. Ratios, number of switches, and number of resistors can vary for inputs other than 4. With these four input signals provided at a single microcontroller input, four user selectable modes are provided, thereby simplifying the microcontroller input and reducing the cost of the microcontroller. The four user selectable modes can include position (1) vacuum off, power outlet is off, auto filter clean is off and filter clean push button is off; position (2) vacuum on, power outlet is off, auto filter clean is off and filter clean push button is on; position (3) vacuum on, power outlet off, auto filter clean is on and filter clean push button is on; and position (4) (auto mode) vacuum is controlled by outlet, auto filter clean is on and filter clean push button is on.

A filter clean switch 80 is also provided for providing a signal to the microcontroller 64 for operating the filter cleaning device via activation of the filter cleaning circuit 66. The filter cleaning circuit 66 includes an opto-coupler 82 which can be activated by a low voltage signal from the microcontroller 64. The opto-coupler 82 provides an activation signal to a triac 84. When the gate of the triac 84 is held active, the triac 84 conducts electricity to the filter cleaning motor 36 for activating the filter cleaning device 34. The opto-coupler 82 requires only a low power input for holding the triac 84 active. Additionally, the triac may be held continuously active for a time period then turned inactive, or pulsed active/inactive for a timer period, or the triac may be replaced by an SCR and driven with DC in a similar manner just described.

The microcontroller 64 can also provide a control signal to the vacuum circuit 68. The vacuum circuit 68 is provided with an opto-coupler 86 which receives a low voltage signal from the micro-controller 64. The opto-coupler 86 can provide an activation voltage to a triac 88 which is held active by the voltage supplied by the opto-coupler 86 to provide electricity to the vacuum motor 16. The opto-coupler 86 requires only a low power input for holding the triac 88 active.

The power tool sense circuit 70 is provided with a current transformer 90 that senses current passing through an electrical connection to the power outlet 72 that supplies power to a power tool that can be plugged into the power outlet 72. The current transformer 90 provides a signal to the microcontroller 64 indicative to the activation state of a power tool plugged into the outlet 72. In response to the power tool sense circuit 70, the microcontroller 64 can automatically activate the vacuum motor 16 for driving the vacuum source. Thus, when a power tool is plugged into the outlet 72 and is activated by a user, the vacuum motor 16 can be activated to assist in vacuuming debris that is created by the use of the power tool. The microcontroller 64 can delay deactivation of the vacuum motor 16 after the power tool is deactivated, to allow for the vacuum 10 to collect debris for a predetermined period of time after the power tool is deactivated.

Figure 7:
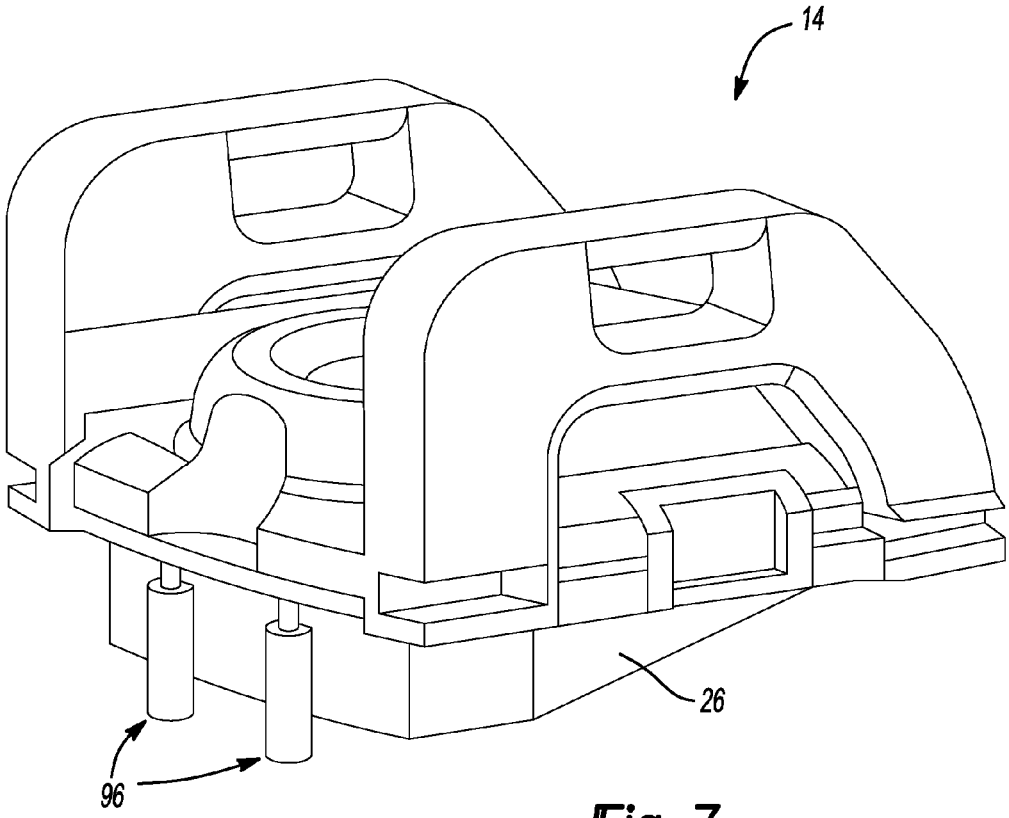
FIG. 7 is a perspective view of a head portion of an industrial shop vacuum, according to the principles of the present disclosure, illustrating the water detection probes.

The water sense circuit 74 includes a pair of water sense probes 96 disposed within the canister 12 of the vacuum 10. As illustrated in FIG. 7, probes 96 can be connected to vacuum head 14 and can be suspended within the canister 12 below the level of the filter 26. A buffer device 98 buffers the high impedance water sense input. The microcontroller on its own is unreliable in measuring the high impedance water sense input. The output of the buffer device or amplifier 98 goes to an analog input to the microcontroller 64. The microcontroller software determines the analog level to detect water sense. The water sense probes 96 can be brass probes mounted in the vacuum's canister 12. Water contacting between the probes will be detected by the water sense circuit 74 as a lower impedance.

The electrical isolation circuit 62 is provided to eliminate shock hazard. Three components provide isolation including the power supply transformer 100 as well as the current transformer 90 and the opto-couplers 82, 86. The power supply transformer 100 provides a reduced voltage output from the power source 54. By way of example, a five volt reduced power supply VCC can be provided by the electrical isolation circuit 62 from the AC line voltage source 54. The circuit 60 previous to the transformer is the control circuit for the switching supply. The transformer provides isolation and is part of the switching supply. The five volt regulator takes the isolated control circuit output and reduces it to +5V regulated. The low voltage power supply VCC is utilized by the microcontroller 64 for providing signals to the opto-couplers 82, 86 of the filter cleaning circuit 66 and vacuum circuit 68 as well as supplying power to the water sense circuit 74. Furthermore, the ratio switch circuits 76, 78 are supplied with the low voltage VCC power supply.

Figure 4:
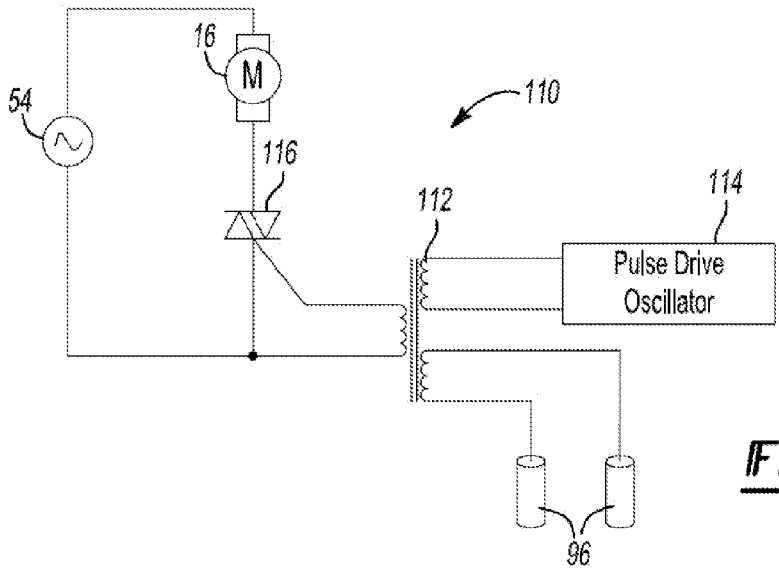
FIG. 4 is a schematic view of a water sense circuit using a gate drive pulse transformer according to the principles of the present disclosure.

With reference to FIG. 4, an alternative water sense circuit 110 is provided for sensing a water level in the canister 12 for deactivating the vacuum motor 16. In the water sense circuit 110, a gate drive pulse transformer 112 is provided along with a pulse drive oscillator 114. The oscillator provides a gate signal to the triac 116. When the water level touches the probes, it essentially shorts out the gate signal turning off the triac 116. When the triac 116 is turned off, the voltage supply 54 to the vacuum motor 16 is interrupted.

Figure 5:
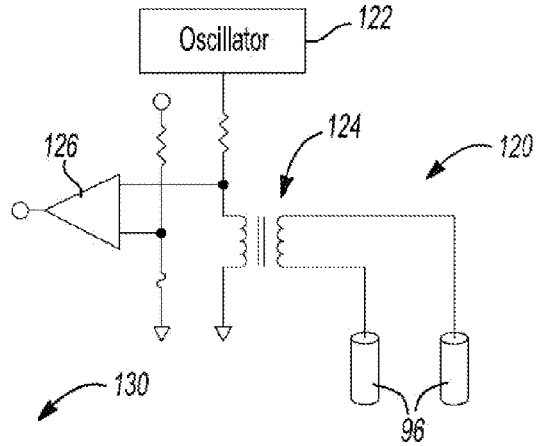
FIG. 5 is a schematic water sense circuit utilizing an oscillator, transformer, and low level detection comparator according to the principles of the present disclosure.

With reference to FIG. 5, an alternative water sense circuit 120 will now be described. The circuit 120 includes an oscillator 122, a transformer 124, and a low level detection in the form of a comparator 126 with no water detected by the water probes 96, the oscillator signal 122 is seen at the op-amp 126. When water is detected, the oscillator signal is eliminated from the op-amp input that is providing a signal to a microcontroller of a detected high water level.

Figure 6:
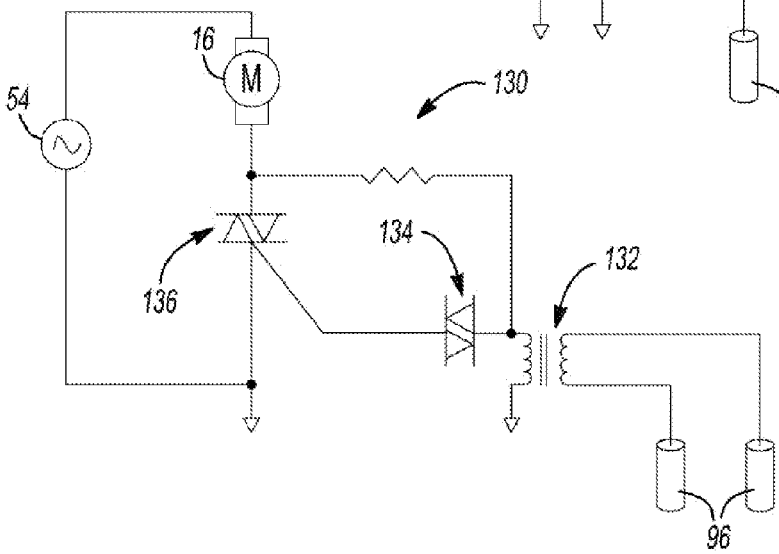
FIG. 6 is a schematic water sense circuit using a line frequency transformer according to the principles of the present disclosure.

With reference to FIG. 6, yet another alternative water sense circuit 130 will now be described. The water sense circuit 130 includes a line frequency transformer 132 to provide water detection. When a water level does not reach the water probes 96, the triac 134 operates at near full voltage. When the water is detected by the water probes 96, the triac gate signal is shorted to common and the triac 136 turns off thereby disconnecting the vacuum motor 16 from the power source 54.

Each of the water sense circuits provide water sense with isolation. A circuit can also be provided with a latching system, meaning when water is detected, the circuit maintains the water detected state even if the water level recedes, until power is cycled or some user reset is enabled. In each case, a triac is shown as the control device. However, other devices such as FETs, IGBTs.

Figure 8:
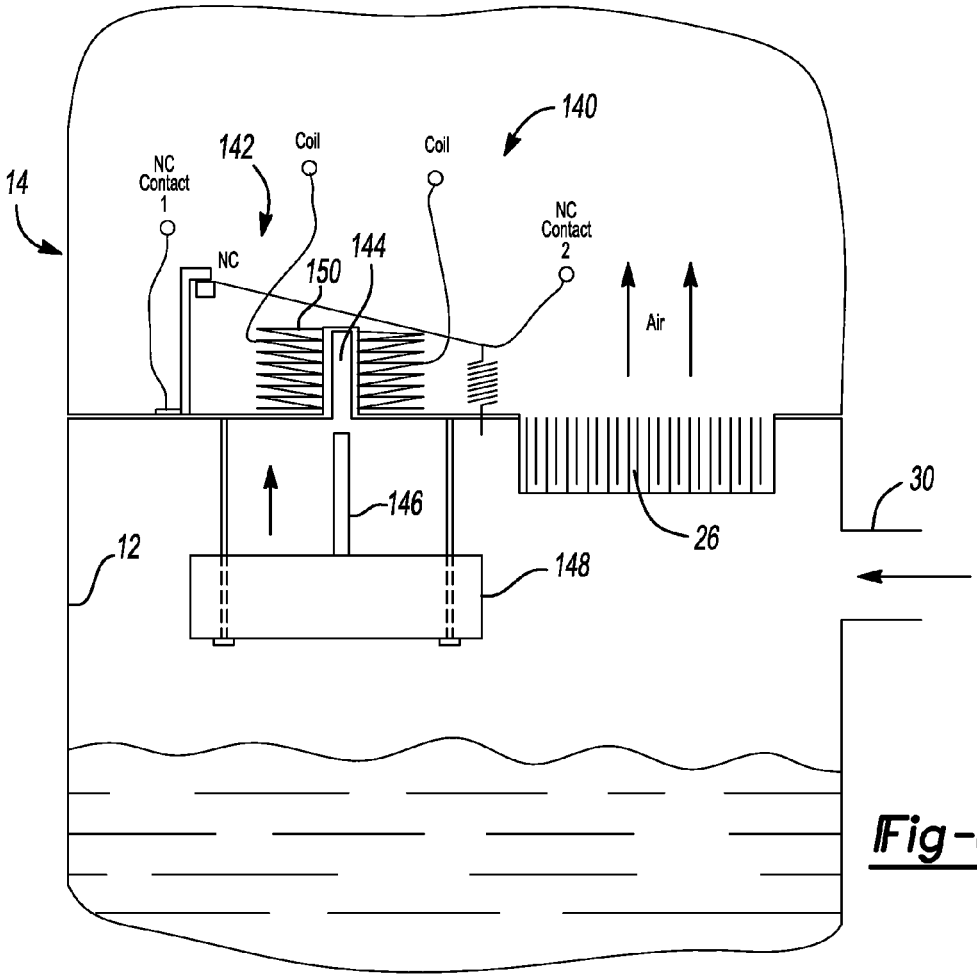
FIG. 8 is a schematic diagram of a electromechanical water sense system using a floating core to provide water level detection according to the principles of the present disclosure.
Figure 9:
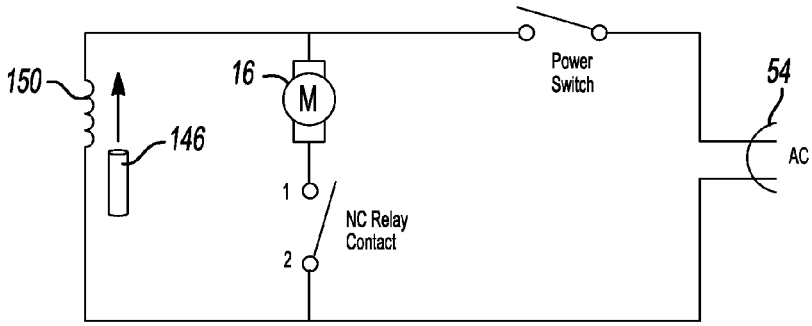
FIG. 9 is a schematic circuit diagram of the water sense system utilizing a floating core according to the principles of the present disclosure.

With reference to FIGS. 8 and 9, an electromechanical water sense system 140 will now be described. The electromechanical water sense system 140 includes a normally closed relay 142 mounted to a hollow boss 144 with a floating core 146. The floating core 146 is on the hollow side of the boss 144. A relay coil 150 is constantly supplied with power but cannot activate (i.e., open the context) because no core is present. However, if water fills the canister 12 the float 148 will rise and the core 146 will insert into the hollow boss 144. Eventually, the core will allow the relay 142 to change states and open the contact and thereby removing power from the vacuum motor 16. Once the core 146 enters the boss 144 and the relay activates, the relay will not change states until power is removed and the water level is reduced. This latching feature prevents the vacuum motor power from cycling on/off and causing water to enter the motor 16. The system requires no extra electronics and provides an economical solution for low-cost vacuums.

Figure 10:
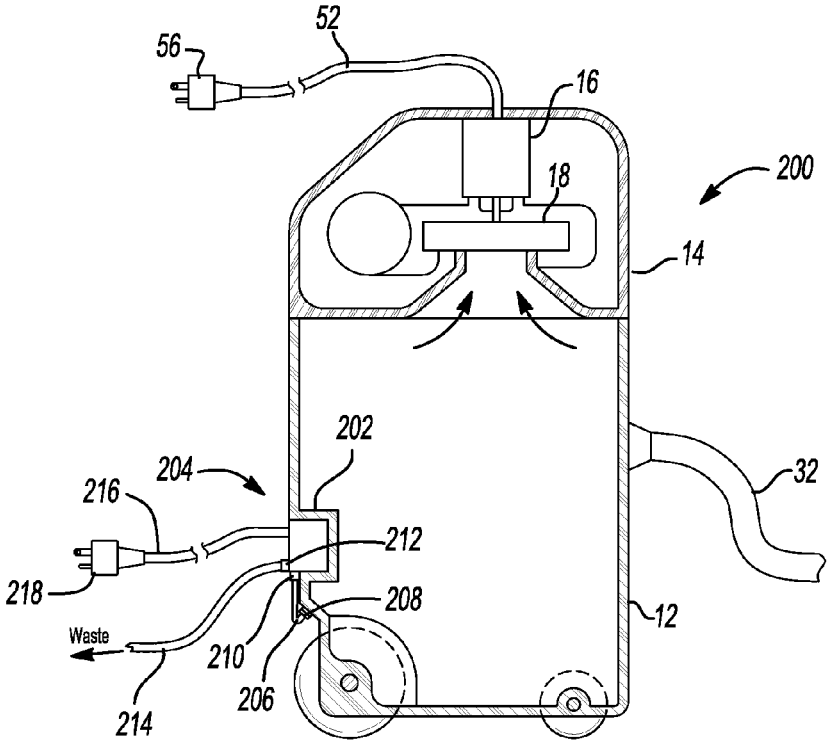
FIG. 10 is a schematic view of a vacuum incorporating a pump according to the principles of the present disclosure.

With reference to FIG. 10, an example vacuum 200 may include a canister 12 and a head 14 that closes the canister 12. The head 14 may support a vacuum motor 16. The vacuum motor 16 may support a suction fan 18. As is well known in the art, the vacuum motor 16 may be connected to a power source via a power cord 52 with a power plug 56. The vacuum motor 16, when powered up by closing a switch (not shown), may rotate the suction fan 18, thereby drawing air from the canister 12. In this way, debris (including liquids) may be drawn through a hose 32 and into the canister 12.

The canister 12 may include a recess 202 in which an eternal pump 204 may be removably mounted. The canister 12 and/or the external pump 204 may include conventional features (i.e., fasteners, latches, ribs, and/or straps) that provisionally secure the external pump 204 in the recess 202. A conduit 206 may be connected between an outlet 208 provided in the canister 12 and an inlet 210 of the external pump 204.

Figure 11:
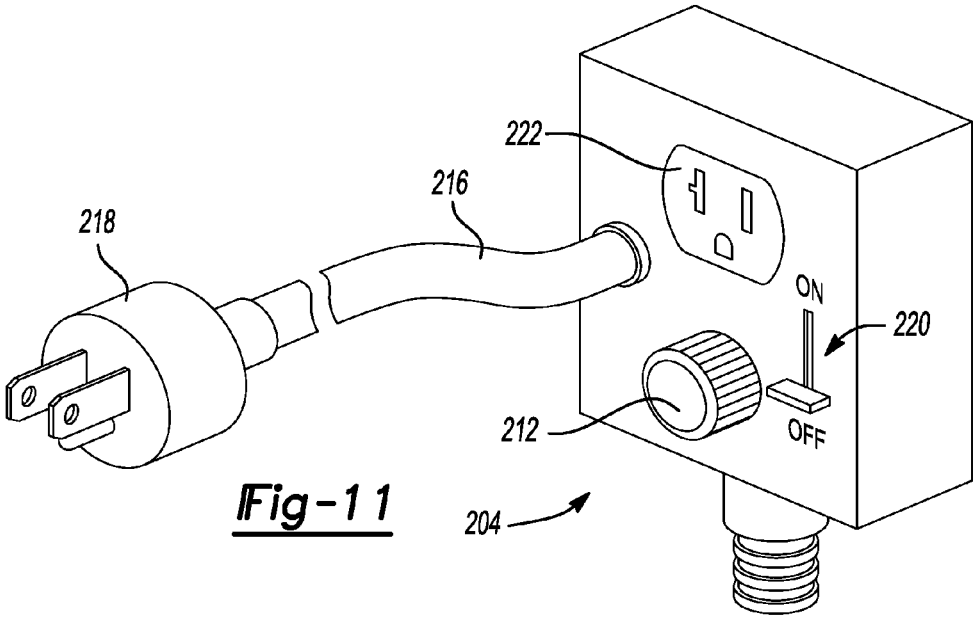
FIG. 11 is a perspective view of a pump according to the principles of the present disclosure.

Turning to FIG. 11, the external pump 204 may include an outlet 212 for connection to a hose 214. As with conventional external pumps, the external pump 204 may include an electric motor (not shown), which may be connected to a power source via a power cord 216 with a power plug 218, and a switch 220 for actuating the external pump 204. A mechanism (i.e., a check valve) may be implemented in the external pump 204 (or between the inlet 210 and the canister 12) to prevent a reverse flow of fluid (i.e., air) through the external pump 204 when the external pump 204 is not activated (i.e., during a dry vacuum operation).

As shown, the external pump 204 may include a power outlet 222 that is electrically connected to the power cord 216. The power outlet 222 may receive the power plug 56 of the vacuum motor 16. Accordingly, a user may plug the power plug 56 of the external pump 204 into a power outlet in a wall (or some other power source), and plug the power plug 56 of the vacuum motor 16 into the power outlet 222 of the external pump 204. In this way, the vacuum motor 16 and the external pump 204 may be driven with only a single power cord (i.e., the power cord 216) being physically connected to a power source, thereby reducing power cord management issues and/or power outlet availability issues.

Example Modifications:

In the disclosed embodiment, the vacuum motor 16 and the external pump 204 may be independently activated via respective switches. However, appropriate control circuitry and/or sensors can be utilized to provide numerous and varied operational features. For example, and with reference to FIG. 12, a controller 310 may be connected to the vacuum motor 16, the switch 220 of the external pump 204, and a sensor 320. Here, the switch 80 could be closed by the operator to enable the controller 310 to activate the external pump 204 based on inputs from the sensor 320. By way of example only, the sensor 320 may be a level sensor detecting the level of liquid in the cannister 12 or alternatively a flow sensor detecting a flow of liquid through the external pump 204. In this way, when the switch 220 is closed, the controller 310 may intermittently activate the external pump 204 based on the inputs from the sensor 320, which may indicate the presence of liquid in the canister 12.

Figure 12:
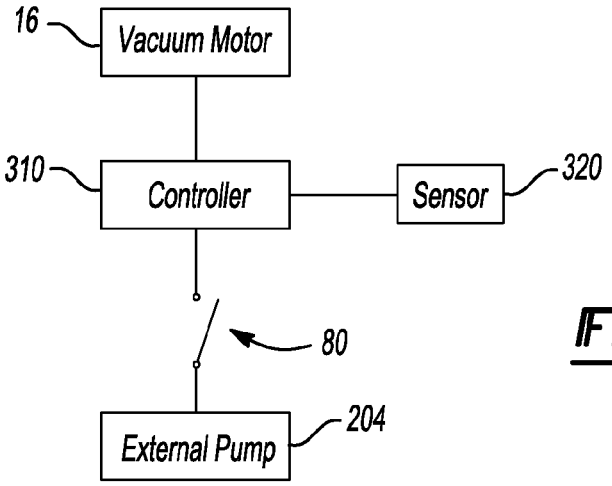
FIG. 12 is a control diagram for use with the external pump according to the principles of the present disclosure.
Figure 13:
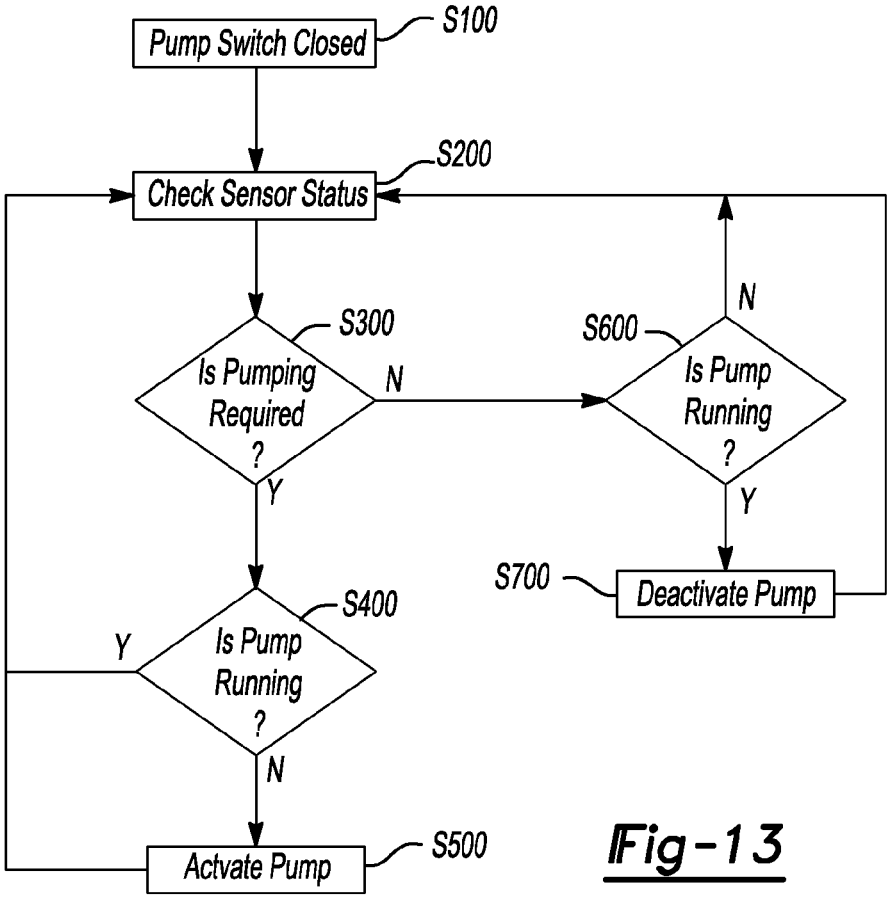
FIG. 13 is a flowchart showing a control method according to the principles of the present disclosure.

FIG. 13 schematically illustrates an example flow diagram of the control process that may be exercised by the controller 310 depicted in FIG. 12. The control process may be initiated when the switch 220 is closed (S100). The controller 310 may check the status of the sensor 320 (S200). Based on inputs from the sensor 320, the controller 310 may determine whether pumping is required (S300). If so, then the controller 310 may determine whether the pump 204 is running (S400). If the pump 204 is not running, then the controller 310 may activate the pump 204 (S500). The controller 310 may activate the pump 204 for a determined amount of time, and then loop back to check the status of the sensor (S200). If the pump 204 is running (at S400), then the controller 310 may continue to activate the pump 204, and then loop back to check the status of the sensor (S200).

If the controller 310 determines that pumping is not required based on the inputs from the sensor 320 (as S300), then the controller 310 may determine whether the pump 204 is running (S600). If so, then the controller 310 may deactivate the pump 204 (S700), and then loop back to check the status of the sensor 320 (S200). If the pump 204 is not running (at S600), then the controller 310 may loop back to check the status of the sensor 320 (S200).

In the disclosed embodiment, the vacuum motor 16 may draw power through the external pump 204 by virtue of the power plug 56 of the power cord 52 being plugged into the power outlet 222 of the external pump 204. In an alternative embodiment, the vacuum motor 16 may draw power through the external pump via an auxiliary power path (which could be provided in addition to the power plug 56 and the power cord 52). For example, the vacuum motor 16 may be connected to an auxiliary power line (not shown) with an auxiliary power plug (not shown) mounted in the recess 202 of the canister 12. By way of example only, the auxiliary power line may be embedded in walls of the head 14 and the canister 12. A connector may be provided in the auxiliary power line to facilitate removal of the head 14 from the canister 12. In addition, the external pump 204 may include a power outlet (in addition to, or instead of, the power outlet 222 depicted in FIG. 11) provided on the back face of the external pump 204. In this way, the auxiliary power plug of the vacuum motor 16 would be plugged into the power outlet on the rear face of the external pump 204 upon mounting the external pump 204 in the recess 202 of the canister 12.

In the disclosed embodiment, the vacuum motor 16 may draw power through the external pump 204 by virtue of the power plug 56 of the power cord 52 being plugged into the power outlet 222 of the external pump 204. In an alternative embodiment, the vacuum 200 may include an onboard power outlet that may be electrically connected to the power cord 52. The onboard power socket may received the power plug 218 of the external pump 204. Accordingly, a user may plug the power plug 56 of the vacuum motor 16 into the power outlet in a wall (or some other power source), and plug the power plug 218 of the external pump 204 into the onboard power outlet of the vacuum 200. In this way, the vacuum motor 16 and the external pump 204 may be driven with only a single power cord (i.e., the power cord 52) being physically connected to a power source.

What is claimed is:

1. A vacuum comprising:

a housing defining a debris chamber;

a vacuum source disposed in said housing;

a transformer having a first winding and a second winding inductively coupled to said first winding; and a pair of water sensing probes disposed in said debris chamber and attached to said second winding, wherein current does not flow through said second winding when water is not sensed by said pair of water sensing probes, and wherein current flows through said second winding in response to water being sensed by said pair of water sensing probes, and wherein said vacuum source is disabled when current is flowing through said second winding.

2. The vacuum of claim 1, further comprising a controller for preventing operation of said vacuum source in response to water being sensed by said pair of water sensing probes.

3. The vacuum of claim 2, further comprising:

a pulse drive oscillator attached to said first winding;

a third winding inductively coupled to said first winding; and a triac attached to said third winding, wherein said pulse drive oscillator provides a gate signal to said triac through said third winding when no water is being sensed by said pair of water sensing probes, and wherein said triac does not receive said gate signal when water is being sensed by said pair of water sensing probes.

4. The vacuum of claim 3, wherein said gate signal is diverted from said third winding in response to water being sensed by said pair of water sensing probes.

5. The vacuum of claim 2, further comprising:

an oscillator attached to said first winding that provides an oscillator signal; and an operational amplifier attached to said first winding that provides a signal to said controller that selectively prevents operation of said vacuum source based on said signal, wherein said oscillator signal is received by said operational amplifier when no water is being sensed by said pair of water sensing probes, and wherein said oscillator signal is not received by said operational amplifier when water is being sensed by said pair of water sensing probes.

6. The vacuum according to claim 5, wherein said controller prevents operation of said vacuum in response to water being sensed by said pair of water sensing probes until a power switch is cycled off then on again.

7. The vacuum of claim 5, wherein said oscillator signal is diverted from said operational amplifier in response to water being sensed by said pair of water sensing probes.

8. The vacuum of claim 7, wherein said controller prevents operation of said vacuum in response to water being sensed by said pair of water sensing probes until a power switch is cycled off then on again.

9. The vacuum of claim 2, further comprising:

a first triac attached to said first winding; and a second triac attached to said first winding via said first triac, wherein said first triac provides current to said second triac when no water is being sensed by said pair of water sensing probes.

10. The vacuum of claim 9, wherein current is diverted from said first triac in response to water being sensed by said pair of water sensing probes.

11. The vacuum of claim 10, wherein said controller prevents operation of said vacuum in response to water being sensed by said pair of water sensing probes until a power switch is cycled off then on again.

* * * * *